US005254040A

United States Patent [19]

Eller et al.

[11] Patent Number: 5,254,040

[45] Date of Patent: Oct. 19, 1993

[54] HANDBALL - SQUASH COURT CONVERSION SYSTEM

[76] Inventors: James D. Eller, E. 14420 6th Ave., Spokane, Wash. 99216; Jack L. Cosby, S. 6127 Crestline Ave., Spokane, Wash. 99223

[21] Appl. No.: 775,720

[22] Filed: Oct. 11, 1991

[51] Int. Cl.[5] ..... E06B 7/34

[52] U.S. Cl. ..... 472/94; 49/197

[58] Field of Search ..... 472/92–94; 49/169, 197, 127; 52/264, 64

[56] References Cited

U.S. PATENT DOCUMENTS

| | | | |
|---|---|---|---|
| 959,973 | 5/1910 | Tomkins | 472/94 |
| 1,603,379 | 10/1926 | Dautrick | 49/197 |
| 2,008,000 | 7/1935 | Brunst et al. | 49/197 |
| 2,167,169 | 7/1939 | Bolhuis | 434/72 |
| 2,205,398 | 6/1940 | Eaton | 472/94 |
| 2,323,585 | 7/1943 | Deuring | 49/197 |
| 2,619,165 | 11/1952 | Wolf | 49/197 |
| 3,685,223 | 8/1972 | Sherwood | 52/64 |
| 3,758,106 | 9/1973 | Liebig | 273/411 |
| 3,872,623 | 3/1975 | Spaulding, Jr. | 49/169 |
| 4,070,805 | 1/1978 | Kastner | 52/86 |
| 4,167,839 | 9/1979 | Nielsen | 52/105 |
| 4,199,133 | 4/1980 | Gagnon et al. | 472/78 |
| 4,324,386 | 4/1982 | Gagnon et al. | 472/78 X |
| 4,497,483 | 2/1985 | Ahlgren | 472/94 X |

*Primary Examiner*—Carl D. Friedman
*Assistant Examiner*—Kien Nguyen
*Attorney, Agent, or Firm*—Mark W. Hendricksen

[57] ABSTRACT

This invention generally provides an apparatus and a method for allowing the use of an existing handball court for playing both the game of handball and the game of squash. This invention includes an apparatus and method by which a rear squash wall is fixed at the appropriate location in an existing handball court for use during the play of squash. To then allow the play of handball, the rear squash wall is then detached, moved to the rear of the handball court, lifted to a position over the rear-end of the handball court and suspended behind and above the area of play used for handball. The reverse is performed to convert the handball court back for use for squash.

11 Claims, 2 Drawing Sheets

HANDBALL - SQUASH COURT CONVERSION SYSTEM

FIELD OF THE INVENTION

This invention generally pertains to a method and apparatus which facilitate the use of existing handball-/racquetball courts to play the game of squash. More particularly, this invention includes a movable rear squash wall which can be secured in an intermediate position within a handball court to allow the court to be used as a squash court. The court can then be converted back for use as a handball court by detaching the intermediately located rear squash wall, moving it to the rear of the handball court, lifting it and then securing it in a position above the rear portion of the handball court and out of the area of play for handball.

BACKGROUND OF THE INVENTION

For many years court and athletic clubs have been faced with the dilemma of trying to determine the number of handball/racquetball courts, and separately, squash courts, to have in their club to provide the facilities desired by their members. As the popularity of the different sports changes, so does the demand for the different types of courts and the needs of various clubs to convert existing courts or achieve a dual use for them.

The game of handball and the game of racquetball are played on a court of the same dimensions and therefore the term handball court and the term racquetball court will be used interchangeably to refer to the same court. The games of handball and racquetball are played utilizing all six surfaces of the court, namely the front wall, the floor, the two side walls, the rear wall and the ceiling. The rear wall in the courts in many clubs is partially or completely transparent to allow spectators to more easily watch the games.

There are two types of games commonly referred to as squash, namely "softball" squash and "hardball" squash. The two games are appropriately named for the relative hardness of the balls used for each. The rules are different for each and the prescribed court size can be different, depending on which regulating body's rules are followed.

Squash is played on a court in which the distance between the front wall and the rear wall is approximately eight (8) feet shorter than the court used for handball. Further, for the rear squash wall to meet squash regulations, it must be seven (7) feet in height, whereas in handball, the rear wall is required to be twelve (12) feet in height. The distance between the two sidewalls of a handball court is twenty (20) feet.

The current regulations governing the play of "softball" squash in the United States allow for the game to be played on twenty (20) feet wide courts, although other international governing bodies may prescribe twenty-one (21) feet. In any event, the various regulations are subject to change.

Courts constructed with dimensions for handball and racquetball play cannot also be used for squash unless a means to use an insertable and then removable, intermediate rear squash wall can be found.

In a typical athletic club, there are more handball courts than there are squash courts. However, with the gaining popularity of squash, there is an increasing demand for more squash court time and, consequently, for more squash courts. In order to meet the increasing demand of their members to play squash, athletic clubs are faced with the dilemma of building additional squash courts, at a substantial cost and assuming they have the space, or permanently converting existing handball courts. The latter is not popular among the clubs' handball and racquetball players.

In response to said dilemma, various companies have been attempting to provide a means to allow the same court to be used for both squash and handball. However, the current means heretofore attempted have created several problems and required substantial modifications, including structural modifications, to existing handball courts.

For instance, one system involves the use of a two part rear handball wall, namely a stationary part and a removable part. To convert the court for use for squash, the removable part of the wall is detached and moved into the court to become the squash rear wall. The movement of the removable part of the wall is generally facilitated by a tracking system that must be installed in the floor and/or side walls of the existing handball court. The removable part of the wall, which is the rear squash wall, comprises glass panels and a frame means. The reverse is accomplished to convert the court back for use for handball.

The problems with these systems are, without limitation: they require substantial modification of the rear wall of existing handball courts to allow the glass section to be inserted and removed to accomplish the conversion(s); the tracking system generally requires that recessed grooves be installed, which creates a change in the playing surface on the side walls and interferes with the playing of handball when the ball contacts said grooves; and it is difficult to move the rear squash wall to the location for use in squash, and then difficult to insert it back into the rear handball wall to allow handball to be played.

The existing court conversion systems typically utilize at least a partial glass or transparent surface and some sort of metallic structural frame member, which also becomes a part of the playing surface on the rear wall. This leads to inconsistent bounces off the wall during play and is undesirable.

Our handball court conversion system eliminates the problem of requiring substantial modification to the rear wall of the existing handball court because our invention does not require any modification to the existing rear handball walls.

Our invention eliminates the problems associated with the tracking system interfering with play, by eliminating the need for tracking system altogether.

Our invention greatly reduces the problem of experiencing inconsistent bounces of the handballs off the walls due to frame members comprising part of the playing surface, by eliminating the frame and structural members from exposure on the surface of play. Instead, the playing surface panel(s) are placed directly adjacent to one another and are fixed to the structural components by a suitable adhesive means.

SUMMARY OF THE INVENTION

This invention generally pertains to an apparatus and method for converting an existing handball court so that it can be used for playing both the game of handball and the game of squash.

During the play of the game of squash, a game in which the rear wall is substantially closer to the front wall than for handball, a movable wall is fixed in the proper intermediate location and serves as the rear squash wall.

In order to then facilitate handball, the movable rear squash wall is detached from the side walls and lifted to a location such that it is either partially or fully recessed above the ceiling of the handball court or over the rear portion of the handball court such that it is suspended above and behind the area of play needed for handball. When the handball court is later needed for squash, the rear squash wall is lowered and again secured in the proper position so it can be used for squash.

It is an object of this invention to provide a system which easily converts an existing handball court so that it can be utilized for playing squash, and then easily converts the court back so it can again be used for handball.

It is an object of this invention to provide a system which allows an existing handball court to be utilized for playing squash without requiring substantial structural or other changes to the existing handball court, its rear wall or its two side walls. The advantage of this invention is that it can be installed in existing handball courts without altering the rear handball wall and without the installation of a tracking system on the side walls. This invention can be installed with very minimal and unobtrusive changes to the existing handball court.

It is an object of this invention to provide such a court conversion system which is relatively simple in design. The basic components of the current preferred embodiment of this invention are relatively simple in nature, readily available for use in construction and provide a relatively strong rear squash wall.

It is another object of this invention to provide such a court conversion system which does not interfere with playing handball when the rear squash wall is not being utilized. This invention accomplishes this by using a movable rear squash wall which is raised to a position either above the rear portion of the handball court such that it is not in the area of play typically used for handball, or such that it is partially or fully recessed above the handball court ceiling.

It is a further object of this invention to provide such a system with safety features built into the system design to reduce the potential for an accident to occur, which this invention does.

Other objects, features and advantages of this invention will appear from the specification, claims and accompanying drawings, which form a part hereof. In carrying out the objects of this invention, it is to be understood that its essential features are susceptible to change in design and structural arrangement with only one preferred embodiment being illustrated in the accompanying drawings, as required.

BRIEF DESCRIPTION OF DRAWINGS

In the accompanying drawings which form a part hereof.

DESCRIPTION OF THE PREFERRED EMBODIMENTS

This invention generally pertains to an apparatus and method for allowing the use of existing handball courts to play the game of squash, in addition to handball.

Many of the fastening and connection means and other components utilized in this invention are widely known and used in the field of the invention described, and their exact nature or type is not necessary for an understanding and use of the invention by a person skilled in the art or science, and they will not therefore be discussed in significant detail.

The specific components shown or described herein can be varied or altered as anticipated by this invention. This invention comprises a unique combination of steps and elements for application to a court conversion system. Each element can be accomplished by one of several different means or variations to achieve a specific application of what is considered to be this invention. The practice of a specific application of any single element may already be widely known or used in the art or by persons skilled in the art or science and each may not therefore be discussed in significant detail.

Figure 1:
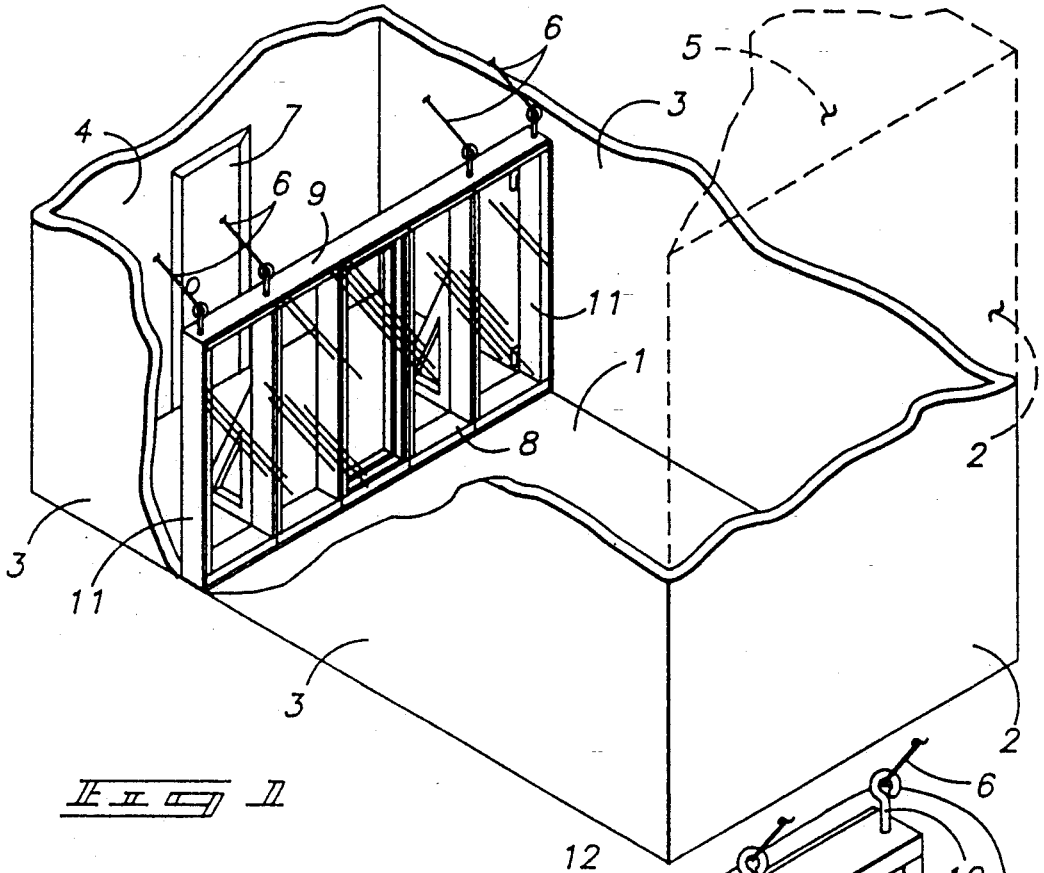
FIG. 1 is a perspective view of the handball court with one application of the rear squash wall in an intermediate position within the court for playing squash.

FIG. 1 shows a perspective view of the handball court with one application of the rear squash wall in an intermediate position within the court for playing squash. FIG. 1 illustrates the floor 1, the front wall 2, the two side walls 3, the rear handball wall 4 and the ceiling wall 5. FIG. 1 also shows the rear squash wall intermediately placed to play the game of squash, with its four connecting cables 6, which attach to the hoist means.

Figure 2:
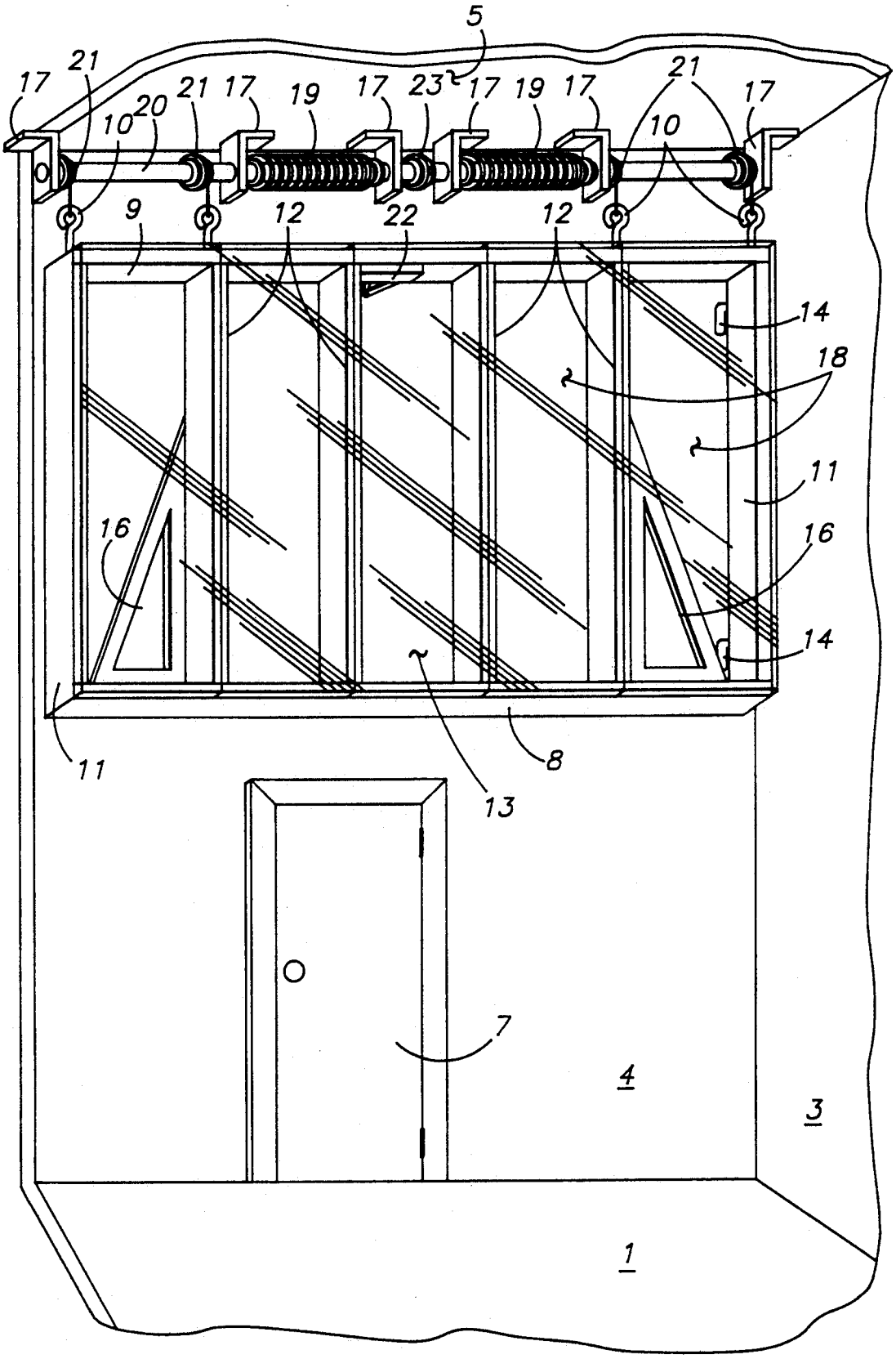
FIG. 2 is a perspective view of one application of the rear squash wall suspended above the handball court and in a position which allows the court to be used to play handball.

FIG. 2 shows one application of the rear squash wall suspended above the playing area of the handball court and in a position which allows the court to be used to play handball.

The apparatus contemplated by this invention generally includes: a rear squash wall which can be fixed in an intermediate position within an existing handball court; and a hoist means connected to said rear squash wall, which, to facilitate the play of handball, lifts and then suspends the rear squash wall to a position over the rear portion of the handball court out of the area of play for handball, and which lowers the rear squash wall back down to the court floor.

There are multiple means to accomplish each of these general components and remain within the contemplation of this invention, as it is the combination of elements applied to the conversion of handball/racquetball courts which is claimed as the invention.

The method contemplated by this invention to convert the court set up for squash so it can be used to play handball generally includes the following steps: attaching a movable rear squash wall at an appropriate intermediate position within a handball court for use to play the game of squash; detaching the rear squash wall; moving the rear squash wall to the rear portion of the handball court; and then lifting the rear squash wall to a location where it can be suspended above the rear portion of the handball court such that it does not interfere with the play of the game of handball. The reverse is performed to convert the handball court back so that it can be used to play the game of squash.

There are numerous types of rear squash walls which can be utilized within the contemplation of this invention. To meet current United States "softball" squash regulations, the rear squash wall must be at least seven (7) feet in height and be twenty (20) feet in width. The width requirement is so that the wall fits within and coincides with the width of regulation-sized handball courts.

The rear squash wall is generally comprised of a playing surface and a structural support means. The playing surface and the structural support means are generally separate, but may be integrated or combined.

The playing surface 18 of the rear squash wall faces the inside of the court, is flat, must be as free from cracks and obstructions as possible and must include a means for players to enter and exit the squash court. The playing surface 18 may be comprised of one or more sections, depending on the ease of assembly desired and the composition of the specific material used as the playing surface.

The playing surface 18 can be made of any material or combination of materials suitable or desirable as a playing surface for the game of squash, such as plywood, wallboard, glass, plastic or other laminated surfaces applied to plywood or other types of wallboard.

The preferred embodiment for the playing surface 18 utilizes as the material of choice, one-quarter (¼) inch clear-float tempered glass with all exposed edges polished.

Figure 3:
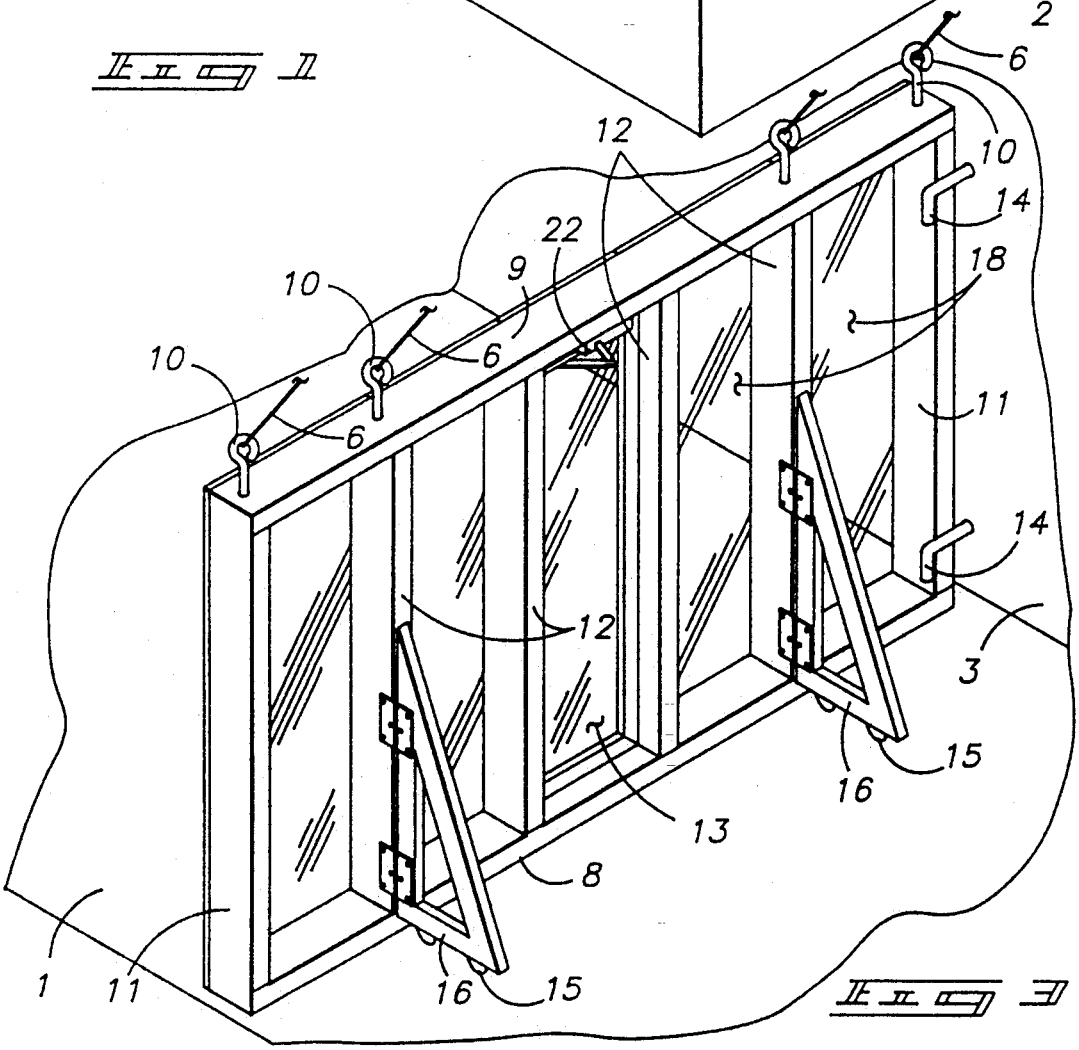
FIG. 3 is a perspective rear view of one application of the rear squash wall in position for playing the game of squash in the handball court.

In the preferred embodiment of this invention, as shown in FIGS. 2 and 3, the playing surface is comprised of four (4) tempered glass panels 18, and a door panel 13, which is constructed of the same tempered glass structural material as the other four (4) panels.

The tempered glass panels 18 are secured to the structural support means by an adhesive. The adhesive means can be accomplished a number of different ways, including different types of structural adhesives, such as "GE 1200" (black or silver), which is a product of the General Electric Company. The adhesive material is applied to the structural support means and the tempered glass panels 18 are then attached to and supported by said adhesive means.

The door panel 13 is pivotally attached to the structural support means by hinges such that it can be alternately opened and closed. In the preferred embodiment, the door panel 13 has two small-diameter holes drilled at an intermediate position in the door panel 13 to allow players to stick their fingers in the holes to grasp the door to open or to close it. The preferred embodiment also includes an automatic door closer 22, which causes the door to automatically close and remain closed.

In order to obtain the most continuous playing surface, a sealant is applied between the adjacent, abutting ends of the glass panels 18 and the abutting ends between the glass panels 18 and the door panel 13, in such a manner as to make the entire playing surface as continuous as possible. This sealant can also be a structural silicon material, such as "GE 1200" (black or silver), which would also provide additional structural support and a narrow buffer between each of the adjacent glass panels and between each glass panel and the structural members.

The preferred embodiment also includes a neoprene strip, approximately one-quarter inch by one-half inch, between the structural support means members and the tempered glass panels 18. The neoprene strip provides a buffer in addition to the structural silicon to help absorb the impacts from collisions by players.

The structural support means for the rear squash wall can also be accomplished by several different means. The main function of the structural support means is to provide a structure to support the playing surface in a vertical position and to buttress the rear wall to render it sufficiently rigid to withstand the impact when players collide with the wall. The structural support means can be constructed of any type of structural materials, such as metal, aluminum, wood, plywood or the like, or any combination of the foregoing.

The structural support means generally must have the capability to attach to the floor and side walls of the handball court and must provide sufficient support to withstand the collisions referred to above.

FIG. 2 also illustrates one means and the current preferred embodiment, to provide a structural support means for the rear squash wall. The rear squash wall is generally rectangular in its overall shape, with a lower horizontal frame member 8 and an upper horizontal frame member 9. These horizontal frame members 8 and 9, the vertical outer frame members 11 and the vertical inner frame members 12, are preferably constructed of extruded aluminum with an internal structural support means, such as series 3100 curtain wall, 66063-T5 alloy and temper (ASTM B221 allow G.S. 10A-T5).

The horizontal and vertical frame members can be attached to one another by several means, such as welding, bolts or other known fastening means, to name a few. In the preferred embodiment, the eyelets 10 are coupled to metal rods, threaded at their bottom, and which extend downward through the entire length of the vertical frame members. The lower threaded end of the metal rods, after passing through the lower horizontal frame member 8, then bolt to and around the lower horizontal frame member 8, tending to pull the upper horizontal member 9 and the lower horizontal frame member 8, toward one another, and thereby placing the vertical frame members 11 and 12, in compression.

While not necessary to practice this invention, the use of the rods through the vertical frame members and through the lower horizontal frame member 8, allows the lifting of the rear squash wall to occur from the bottom of the wall instead of from the top, thereby tending to place the vertical frame members and wall in compression versus in tension.

The area in the center of the rear squash wall facilitates a doorway 13 into the squash court area.

In order to provide support to allow the rear squash wall to be moved, rear squash wall supports 16 are attached to the back side of the rear squash wall. These rear squash wall supports 16 can be attached to the rear squash wall many different ways. The bottom side is configured such that the rear squash wall can be tilted back to rest on the rollers 15, which can be mounted on the bottom side of the rear squash wall supports 16, and the rear squash wall can then be rolled on the court. FIG. 3 shows the rear squash wall supports 16 attached to the inner vertical frame members 12 by a hinge means so that they can be rotated out of the way when not being used. The bottom side of the rear squash wall supports 16 can be sloped upward away from the rear squash wall to all the wall to be tilted so as to be supported by the rollers 15. The rear squash wall supports 16 can be fixed in the proper position for support by several known means.

In the preferred embodiment, the playing surface side of the lower horizontal frame member 8 also includes a small angle iron, one side of which extends inward towards the court such that it provides additional structural support for the playing surface panels 18.

Many different means can be utilized to fix the rear squash wall to the floor 1 and side walls 3 of the existing handball courts, such as the spring-biased barrel bolts 14, shown in FIGS. 2 and 3. The use of barrel bolts 14 to secure the rear squash wall to the handball courts requires small receiving holes in the walls and floor of the existing courts, thereby minimizing the effect on the playing surfaces when handball is being played on the court.

There are numerous specific ways to accomplish the hoist means within the contemplation of this invention. The hoist means contemplated by this invention generally lifts the rear squash wall from the floor to its overhead position during handball, holds it in that position until it is again needed for squash, and then lowers it back down to the floor.

The hoist means can be manually operated or driven by an electric motor or other power equipment, or both.

The overhead position to which the hoist means lifts the rear squash wall can actually be a couple of different locations within the contemplation of this invention, namely: parallel to the rear handball wall and above and beyond the area typically utilized for the play of handball; or partially or wholly recessed into and above the handball court ceiling. If the rear squash wall is wholly or partially located above the handball court ceiling, the location where it enters the ceiling is preferably directly above where it is utilized to play squash, but can be located at nearly any location in or above the ceiling.

If the rear squash wall is partially or wholly recessed into the ceiling of the handball court, the handball court ceiling would have to be modified to provide the opening to receive the rear squash wall.

FIG. 2 shows one application and the preferred embodiment of the hoist means, excluding the means to rotate the shaft 20, which is known in the art.

In the preferred embodiment, the hoist means is generally comprised of: a shaft 20; sleeve bearing mounting brackets 17, which support the shaft 20 and facilitate its rotation; pulleys 21 to attach to and receive the connecting cables 6; helical springs 19 to counter-balance the load; and a means to rotate the shaft to raise and lower the rear squash wall.

The shaft 20 can be one continuous shaft or can be two or more separate shafts connected by a shaft coupler 23, to form one continuous shaft 20.

The sleeve bearing mounting brackets 17 are generally attached or connected to components of the ceiling or structural support system of the existing handball courts, such as the trusses or other supports. The sleeve bearing mounting brackets 17 may also be attached to a secondary structure which can be installed for the purpose of supporting this invention, and which are already known in the art. The foregoing depends on the specific court to which the invention is being installed.

In the case that the hoist means lifts the rear squash wall such that it is partially or wholly recessed above the handball court ceiling, as stated above, the hoist means would typically be mounted to a structural member above the ceiling level of the existing handball court.

While not necessary to practice this invention, the shaft 20 in the preferred embodiment is counter-balanced with wire torsion helical springs 19, which are spring biased by counter-winding.

Pulleys 21 fixed on the shaft 20 are connected to the end of and which receive the connecting cables 6, which are connected on their other end to eyelet bolts 10. These pulleys 21 are also sometimes referred to as drums, and one end of the connecting cables 6 are attached to and then wind and un-wind on the pulleys 21.

In the preferred embodiment, the primary means to rotate the shaft to raise and lower the rear squash wall is a one-half (½) horsepower gear hoist operator, which can be mounted and operated near the shaft 20. The preferred embodiment also includes a secondary means to rotate the shaft, which is a manual hoist operation system actuated by manual operation of a chain. The gear hoist operator can be set up to operate by a number of different known control means.

The preferred embodiment of this invention has a safety feature, an electric solenoid brake, which catches and then supports the rear squash wall should the hoist system fail for any reason when the rear squash wall is suspended off the ground.

The preferred embodiment of this invention has another safety feature which controls the length of the connecting cables 6 such that if the rear squash wall should start to fall when on the court floor, it will be caught by reaching the end of free connecting cable 6 before hitting the floor.

The immediately forenamed safety feature is achieved by setting limit switches controlling the amount of allowable shaft rotation and controlling the usable length of the connecting cables 6.

While the preferred embodiment for the invention has been described in detail, those familiar with the art to which this invention relates will recognize various alternative designs and embodiments for carrying out the invention, as defined by the claims which follow.

The invention claimed is:

1. An apparatus which allows a handball court, comprised of a front wall, two side walls, a rear wall, a ceiling and a floor, to be used to play the game of squash in addition to the game of handball, and which comprises:

a. a rear squash wall comprised of:
   i. a vertical playing surface; and
   ii. a structural support means to which said playing surface is attached, and which is attachable to and detachable at an intermediate position perpendicular to the two side walls of the handball court, wherein the vertical playing surface facilitates playing the game of squash, and which includes a means through which squash players can enter and exit; and b. a hoist means attached to a structural member which provides structural support for the handball court, and said hoist means which is operatively connected to said rear squash wall such that the hoist means lifts the rear squash wall to and suspends it at a position over a rear portion of the handball court so that the rear squash wall is above the area used to play handball and approximately parallel to the rear wall of the handball court, and said hoist means which can also lower the rear squash wall back down to the floor of the handball court for re-attachment to the handball court to play the game of squash.

2. An apparatus as recited in claim 1, wherein the rear squash wall is comprised of an integrated a vertical playing surface and structural support means.

3. An apparatus as recited in claim 1, wherein the playing surface is comprised of four tempered glass panels and one tempered glass door panel, which are adhesively attached to the structural support means such that the side edges of tempered glass panels abut the glass panel(s) or door panel to which each is adjacent.

4. An apparatus as recited in claim 1, wherein the hoist means is attached to a structural member at a location above the ceiling of the handball court.

5. An apparatus as recited in claim 1, wherein the hoist means is attached to a structural member at a location behind the rear wall of the handball court.

6. An apparatus as recited in claim 1, wherein the hoist means is further comprised of:

a. a shaft means operatively connected to the rear squash wall such that the rotation of the shaft means causes the lifting or lowering of the rear squash wall;

b. a means to secure the shaft means to the structural member which provides structural support for the handball court, such that the shaft can rotate about its longitudinal axis;

c. a means to rotate the shaft means; and d. a means to prevent the shaft means from rotating.

7. An apparatus as recited in claim 1, wherein the hoist means lifts the rear squash wall to and suspends it at a position over the rear portion of the handball court so that the rear squash wall is not only above, but is also behind, the area used to play handball, and approximately parallel to the rear wall of the handball court.

8. A method to convert a handball court, comprised of a front wall, two side walls, a rear wall, a ceiling and a floor, for use to play the game of squash, and then to revert the handball court for use to play handball, which comprises the following steps:

a. lowering a rear squash wall from a position where it is suspended over a rear portion of the handball court and above the area used to play handball, to the floor of the handball court;

b. then moving the rear squash wall forward from the rear portion of the handball court to an intermediate position perpendicular to the two side walls of the handball court, such that the rear squash wall is properly located to play the game of squash;

c. then securing the rear squash wall to the handball court so that it can be used to play the game of squash;

d. then, when it is again desired to play handball, detaching said rear squash wall from the handball court;

e. then moving said rear squash wall from its intermediate position in the handball court to the rear portion of the handball court; and f. then lifting said rear squash wall to a position over the area used to play handball and approximately parallel to the rear wall of the handball court, and suspending it there until it is desired to again play the game of squash.

9. A method as recited in claim 8, but in which the rear squash wall is lowered from a recessed position in the ceiling, where it is suspended over a rear portion of the handball court.

10. A method to convert a handball court, comprised of a front wall, two side walls, a rear wall, a ceiling and a floor for use to play the game of squash, and then to revert the handball court for use to play handball, which comprises the following steps:

a. lowering a rear squash wall from a position where it is suspended partially or wholly recessed above the ceiling of the handball court to the floor of the handball court;

b. then securely attaching the rear squash wall to the handball court so that it can be used to play the game of squash;

c. then, when it is again desired to play handball, detaching said rear squash wall from the handball court;

d. then moving said rear squash wall from its intermediate position in the handball court to a rear position of the handball court; and e. then lifting said rear squash wall to a position over the area used to play handball and approximately parallel to the rear wall of the handball court, and suspending it there until it is desired to again play the game of squash.

11. A method as recited in claim 10, but in which the rear squash wall, after being lowered to the floor of the handball court, must be moved to the intermediate position perpendicular to the two side walls of the handball court, such that it is properly located to play the game of squash.

* * * * *